US007054573B2

(12) United States Patent
Hirai et al.

(10) Patent No.: US 7,054,573 B2
(45) Date of Patent: May 30, 2006

(54) HEATING APPARATUS

(75) Inventors: Masahide Hirai, Shizuoka (JP); Masao Umezawa, Shizuoka (JP); Toshikazu Tsuchiya, Shizuoka (JP); Tomoo Akizuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/808,480

(22) Filed: Mar. 25, 2004

(65) Prior Publication Data

US 2004/0218943 A1 Nov. 4, 2004

(30) Foreign Application Priority Data

Mar. 26, 2003 (JP) ..... 2003-085099

(51) Int. Cl.
*G03G 15/20* (2006.01)

(52) U.S. Cl. ..... 399/70; 399/69; 399/44

(58) Field of Classification Search ..... 399/44, 399/67, 69, 328, 329, 70; 219/216
See application file for complete search history.

(56) References Cited

U.S. PATENT DOCUMENTS

| | | | | |
|---|---|---|---|---|
| 4,949,131 | A * | 8/1990 | Ito | 399/69 |
| 5,300,999 | A * | 4/1994 | Koh et al. | 399/329 |
| 5,329,342 | A * | 7/1994 | Shirai et al. | 399/33 |
| 5,987,275 | A * | 11/1999 | Toyohara et al. | 399/70 |
| 6,006,052 | A * | 12/1999 | Kamimura et al. | 399/69 |
| 6,157,806 | A * | 12/2000 | Elbert et al. | 399/329 |
| 6,175,699 | B1 | 1/2001 | Kato et al. | 399/69 |
| 6,185,388 | B1 * | 2/2001 | Yamamoto | 399/69 |
| 6,292,647 | B1 * | 9/2001 | Ishida | 399/330 |
| 6,347,201 | B1 | 2/2002 | Sano et al. | 399/67 |
| 6,430,386 | B1 | 8/2002 | Okubo et al. | 399/328 |
| 6,453,131 | B1 * | 9/2002 | Sasai | 399/70 |
| 6,496,665 | B1 * | 12/2002 | Umezawa et al. | 399/67 |
| 6,498,911 | B1 * | 12/2002 | Hiroki et al. | 399/69 |
| 6,518,546 | B1 | 2/2003 | Otsuka et al. | 219/216 |
| 6,522,844 | B1 * | 2/2003 | Yamane et al. | 399/67 |
| 6,625,405 | B1 * | 9/2003 | Umezawa et al. | 399/67 |
| 6,810,220 | B1 * | 10/2003 | Hamada et al. | 399/69 |
| 6,651,026 | B1 * | 11/2003 | Yamauchi et al. | 702/132 |
| 6,795,681 | B1 * | 9/2004 | Onodera et al. | 399/341 |
| 6,907,221 | B1 * | 6/2005 | Tanino et al. | 399/329 |
| 6,950,616 | B1 * | 9/2005 | Saito et al. | 399/69 |
| 2002/0031360 | A1 * | 3/2002 | Umezawa et al. | 399/67 |
| 2003/0123893 | A1 * | 7/2003 | Fukano et al. | 399/69 |
| 2004/0033084 | A1 | 2/2004 | Akizuki et al. | 399/69 |
| 2004/0086295 | A1 * | 5/2004 | Peng et al. | 399/69 |

(Continued)

FOREIGN PATENT DOCUMENTS

| | | |
|---|---|---|
| JP | 3-123339 | 5/1991 |

(Continued)

*Primary Examiner*—R. Alexander Smith
(74) *Attorney, Agent, or Firm*—Fitzpatrick, Cella, Harper & Scinto

(57) ABSTRACT

The heating apparatus includes a first temperature detecting element disposed at least in proximity to a moving member, a second temperature detecting element for detecting the temperature of the heating member or the atmospheric temperature of the apparatus, a controlling portion for controlling electric power supply to the heating member, and a judging portion for judging on the basis of the result of the detection by the second temperature detecting element whether the electrical energization of the heating member should be effected before the start of the movement driving of the moving member, whereby temperature control is effected accurately and at the same time, the slip of the moving member, any increase in driving torque, etc. are prevented.

20 Claims, 12 Drawing Sheets

U.S. PATENT DOCUMENTS

| | | | | |
|---|---|---|---|---|
| 2004/0105693 | A1* | 6/2004 | Akizuki et al. | 399/69 |
| 2004/0197112 | A1* | 10/2004 | Saito et al. | 399/69 |
| 2006/0013607 | A1* | 1/2006 | Yoshikawa | 399/69 |

FOREIGN PATENT DOCUMENTS

| | | |
|---|---|---|
| JP | 6-222694 | 8/1994 |
| JP | 6-250565 | 9/1994 |
| JP | 2-833088 | 10/1998 |
| JP | 3051085 | 3/2000 |
| JP | 2001-228731 | 8/2001 |
| JP | 2002-244479 | 8/2002 |
| JP | 2003-84618 | 3/2003 |

* cited by examiner

HEATING APPARATUS

BACKGROUND OF THE INVENTION

1. Field of the Invention

This invention relates to a heating apparatus suitable for use as a toner image fixing apparatus mounted in an image forming apparatus such as a copying machine, a laser beam printer or a facsimile apparatus.

More particularly, this invention relates to a toner image fixing apparatus of a type which heats and fixes an unfixed toner image corresponding to desired image information formed and borne on the surface of a recording material (such as paper, printing paper, a transferring material sheet, an OHT sheet, glossy paper or glossy film) by a direct method or a transferring method, as a permanently secured image on the surface of the recording material bearing the image thereon, by suitable image forming process means such as electrophotography, electrostatic recording or magnetic recording by the use of a toner comprising heat-soluble resin or the like, and an image forming apparatus such as a laser beam printer or a facsimile apparatus carrying the same fixing apparatus thereon.

Still more particularly, this invention relates to an on-demand fixing apparatus suitable for use in a color image forming apparatus and low in cost as well as short in rising time (so-called warm-up time).

2. Description of Related Art

In recent years, coloring in image forming apparatuses such as printers and copying machines have been advanced.

1) As a fixing apparatus used in such a color image forming apparatus, the fixing by a heat roller by a heat roller having an elastic layer on a fixing member is well known. An example of a fixing apparatus using a fixing roller having such an elastic layer is shown in FIG. 12 of the accompanying drawings.

In this fixing apparatus, design is made such that a recording material P bearing an unfixed toner image t thereon can pass through a contact nip portion (fixing nip) N between two heating rollers comprising a fixing roller 101 and a pressure roller 102 rotatively driven in the directions of arrows and adjusted to a predetermined fixing temperature.

The unfixed toner image t, when it passes through the nip portion N, is heated and pressurized by the fixing roller 101 and the pressure roller 102, and is fixed as a completed image (permanently adhered image) on the recording material P.

Each of the rollers 101 and 102 is provided with a halogen heater H centrally thereof, and they absorb radiation energy generated from the heaters H by aluminum mandrels 101*a* and 102*a* inside the respective rollers and are heated. Thermistors 103 and 104 are resiliently brought into contact with the surfaces of the respective rollers 101 and 102, and the electrical energization of the halogen heaters H of the respective rollers 101 and 102 is controlled on the basis of temperatures detected by the thermistors 103 and 104, and temperature adjustment is effected.

Elastic layers 101*b* and 102*b* of silicone rubber having a thickness of 2 mm are provided around the aluminum mandrels 101*a* and 102*a*, respectively, of the rollers 101 and 102, and on the outer surfaces of the rollers, there are further provided coating layers 101*c* and 102*c* of resin good in mold releasing ability and heat resisting property such as PFA (tetrafluoroethylene perfluoroalkyl ether copolymer/tetrafluoroethylene perfluoroalkyl vinylether copolymer resin), or FEP (tetrafluoroethylene hexafluoropropylene copolymer/ethylene tetrafluoride propylene hexafluoride copolymer resin) in order to prevent the toner, paper dust, etc. from being secured thereto.

It is for fixing the surface of the toner image as uniformly as possible that in the fixing nip portion N, the elastic layer 101*b* is provided on the fixing roller 101 side which is a fixing member contacted by the unfixed toner t.

By the elastic layer 101*b* being provided on the fixing roller 101 side, the elastic layer 101*b* is deformed along the toner layer when the toner image t passes through the fixing nip portion N, whereby the toner non-uniformly borne on the image is wrapped by the elastic layer 101*b* and is uniformly given heat, whereby uniform fixing is achieved.

The thus uniformly fixed image has the feature that it is free of uneven gloss, and particularly is excellent in the light transmissivity of the image when an overhead projector transparent (OHT) sheet is fixed.

However, the fixing apparatus of the heat roller type having such an elastic layer has suffered from the problem that the heat capacity of the heat roller itself becomes great and the time (warm-up time) necessary for the fixing roller 101 to be raised to a temperature suitable for toner image fixing is long. Also, the cost of the fixing member has been high.

2) On the other hand, as a fixing apparatus which is short in the warm-up time and inexpensive, there is well known a fixing apparatus of a film fixing type used in a black-and-white printer or the like. An example of such a film fixing apparatus is shown in FIG. 13 of the accompanying drawings.

This fixing apparatus is of a construction in which thin fixing film 111 is interposed between a heater 112 fixedly supported by a supporting member 115 and an elastic pressure roller 114 to thereby form a fixing nip portion N, the fixing film 111 is slidingly moved on the surface of the heater 112, a recording material P bearing a toner image t thereon is nipped and transported between the fixing film 111 and the pressure roller 114 in the fixing nip portion N, and the toner image on the recording material is heated by heat from the heater 112 transmitted through the fixing film 111. The unfixed toner image t on the recording material P receives heat and pressure when it passes through the fixing nip portion N, and is fixed as a completely fixed image (permanently adhered image) on the recording material P.

As the fixing film 111, use is made, for example, of endless film of heat-resistant resin having a thickness of the order of 50 μm, and a mold releasing layer (such as a fluorine resin coating layer) having a thickness of 10 μm is formed on the surface thereof, and the heater 112 comprises a ceramic substrate and a resistance heat generating member formed thereon. Temperature detecting means 113 is brought into contact with the heater 112, whereby the temperature of the heater 112 is detected, and temperature control is effected by controlling means, not shown, so that the temperature of the heater 112 may become a predetermined temperature.

Also, in order to make the heat capacity of the fixing film 111 small, an elastic layer is not provided on the fixing film 111.

In the fixing apparatus of such a construction, the heat capacity of the fixing film 111 is very small and therefore, it is possible to raise the temperature of the fixing nip portion N to a temperature capable of fixing the toner image within a short time after electric power has been supplied to the heater 112.

However, when the film fixing apparatus using such fixing film 111 provided with no elastic layer is used as the fixing apparatus of a color image forming apparatus, the surface of the fixing film 111 cannot follow the surface of the recording material P, the unevenness thereof due to the presence or absence of the toner layer, the unevenness of the toner itself, etc., and between a convex portion and a concave portion, a difference occurs to the heat applied from the fixing film. In the convex portion which is in good contact with the fixing film, the heat is well transmitted from the fixing film, and in the concave portion, as compared with the convex portion, it is difficult for the heat from the fixing film to be transmitted.

In a color image, toner layers of a plurality of colors are superimposed and mixed for use and therefore, the unevenness of the toner layers is great as compared with a black-and-white image, and when an elastic layer is absent on the fixing film which is a fixing member, the unevenness of the gloss of a fixed image becomes great to thereby deteriorate the quality of the image, and when the recording material is OHT, transmissivity has been bad when the fixed image has been projected, and this has caused the deterioration of the quality of the image.

So, there has been proposed a fixing apparatus using a fixing belt (fixing film) having an elastic layer in a film fixing apparatus to thereby constitute a low-cost color on-demand fixing apparatus (see, for example, Japanese Patent No. 3051085).

On the other hand, when use is made of the fixing method as described above, it is necessary that the fixing film or the fixing belt be driven to rotate or move and be transported while being slidden on the surface of a heater as a fixedly supported heating member and therefore, for the purpose of reducing the sliding friction with the surface of the heater, grease of the heat-resistant fluorine origin or the like is applied as a lubricant to between the two.

In this case, because of its characteristic, the grease is great in the grease viscosity during a low temperature and therefore, when image forming is executed in a case where for example, the image forming apparatus is left as it is for a predetermined or longer time under a low-temperature environment and the fixing apparatus is in a very cold state, the momentary torque at the starting of the fixing apparatus becomes great because the grease viscosity is in a great state, and the film or the fixing belt may sometimes slip.

Generally, in such a case, there is known a method of energizing the heater before the fixing apparatus is driven, and energizing a motor in a state in which the grease has been sufficiently melted to thereby prevent the slip, but when the heater is energized in a state in which the fixing apparatus has been warmed up earlier than the motor is energized, the temperature of the nip portion becomes higher than necessary, and this has caused hot offset or the damaging of the fixing apparatus in some cases.

So, there has been proposed a method of detecting the temperature of the heater by a temperature detecting element at the starting, and when it is judged on the basis of the result of the detection that the temperature is a predetermined temperature or less, effecting the judgment of the energization of the heater, and electrically energizing the heater before the rotation of the motor is started, and melting the grease to thereby reduce the starting torque.

However, the heat conductivity of silicone rubber or the like used for the elastic layer of the fixing belt is not very high and many members intervene between the surface of the fixing belt and the temperature detecting means for the heater and therefore, responsiveness is bad and it is difficult to effect the temperature control of the surface of the fixing belt by the temperature detecting means for the heater. Particularly, it is difficult to detect by the temperature detecting means for the heater that the transferring material has passed through the fixing apparatus and has taken away the heat of the surface of the fixing belt, whereby the temperature of the surface of the fixing belt has been lowered, or too much time is required of response.

Against such a problem, there has been proposed a method of displacing the disposition of the temperature detecting means from the heater portion to the surface or the inner surface or the like of the fixing belt, and detecting the temperature of the fixing belt itself to thereby control the driving of the heater and effect temperature control.

In this method, however, the temperature control of the fixing belt can be done accurately, but the temperature of the heater itself cannot be detected accurately, and there occurs a case where the temperature of the heater is too much lower or too much higher than the detected temperature by the temperature detecting element.

When as described above, the temperature detecting element is displaced to the surface or the inner surface of the fixing belt in order to accurately detect the temperature of the fixing belt and effect temperature control, the temperature of the heater cannot be directly detected and therefore, there arises the problem that the control of the timing of the energization of the heater and the energization of the motor becomes inaccurate. Thus, due to the unevenness of the heater temperature detection accuracy at the starting, there occurs a case where in spite of the heater itself being at a high temperature, the heater is energized before the motor is energized, and in such a case, the heater excessively rises in temperature and this has caused the occurrence of a faulty image such as hot offset or the deformation or damaging of the elastic layer by the excessive temperature rise, or has given rise to the problem that a member holding the heating member is melted or the heating member is damaged.

SUMMARY OF THE INVENTION

The present invention has been made in view of the above-noted problems and has as its object to provide an on-demand heating apparatus like a film fixing apparatus in which the temperature control of a heating member, i.e., a moving member sliding relative to the heating member is effected accurately and at the same time, the occurrence of a problem such as the slip of the moving member or any increase in driving torque is prevented, and which is free of the damaging of the moving member by heat, the melting or damaging of a supporting member for the heating member, or the damaging of the heating member.

The heating apparatus according to the present invention is a heating apparatus having a heating member disposed while being fixedly supported, a moving member sliding relative to the heating member, and a pressure member brought into pressure contact with the heating member with the moving member interposed therebetween to thereby form a nip, wherein a material to be heated is introduced into between the moving member and the pressure member in the nip and is nipped and transported therebetween and is heated by heat from the heating member transmitted through the moving member, the heating apparatus having:

first temperature detecting means disposed in proximity to or in contact with the moving member;

second temperature detecting means for detecting the temperature of the heating member or the atmospheric temperature of the apparatus;

controlling means for controlling electric power supply to the heating member on the basis of the result of the detection by the first temperature detecting means; and judging means for judging on the basis of the result of the detection by the second temperature detecting means whether the electrical energization of the heating member, should be effected before the start of the movement driving of the moving member.

Thereby, the temperature control of the moving member can be accurately effected by the first temperature detecting means and the temperature of the heating member or the atmospheric temperature of the apparatus can be accurately detected by the second temperature detecting means, and whether the heating member should be electrically energized before the start of the driving and transport of the moving member can be judged and therefore, there can be provided a heating apparatus which is free of the slip of the moving member and any increase in torque at starting, as well as free of the damaging of the moving member by heat, the melting or damaging of a supporting member for the heating member, the damaging of the heating member by excessive temperature rise, etc. and which is thus excellent in safety.

Preferably, the second temperature detecting means is disposed in proximity to or in contact with the heating member, and detects the temperature of the heating member, and more preferably, the heating apparatus further has third temperature detecting means disposed inside or outside the apparatus for detecting the atmospheric temperature of the apparatus, and the judging means judges on the basis of the result of the detection by both of the second temperature detecting means and the third temperature detecting means whether the electrical energization of the heating member should be effected before the start of the movement driving of the moving member.

Thereby, the temperature control of the moving member can be accurately effected by the first temperature detecting means and both of the environmental temperature and the temperature of the heating member can be detected to thereby judge whether the heating member should be electrically energized before the start of the driving and transport of the moving member and therefore, there can be provided a heating apparatus which is always free of the slip of the moving member and any increase in torque at the starting, as well as tree of the damaging of the moving member by heat, the melting or damaging of the supporting member for the heating member, the damaging of the heating member by excessive temperature rise, etc. and which is thus excellent in safety.

Preferably, the second temperature detecting means is disposed inside or outside the apparatus, and detects the atmospheric temperature of the apparatus.

Preferably, the first temperature detecting means is disposed in contact with the moving member.

Thereby, it is made possible to detect the temperature of the moving member more accurately, and effect stable temperature control.

Preferably, the first temperature detecting means is disposed in contact with the inner surface of the moving member.

Thereby, it is made possible to detect the temperature of the moving member more accurately, and effect stable temperature control.

Preferably, the second temperature detecting means is disposed in contact with the heating member.

Thereby, the accurate temperature of the heating member can be monitored accurately, and whether the heating member should be electrically energized before the start of the driving and transport can be judged and therefore, there can be provided a heating apparatus which is free of the slip of the moving member and any increase in torque at the starting, as well as free of the damaging of the moving member by heat, the melting or damaging of the supporting member for the heating member, the damaging of the heating member by excessive temperature rise, etc. and which is thus excellent in safety.

Preferably, the moving member is a fixing belt, and the material to be heated is a recording material bearing thereon an unfixed toner image to be heated and fixed.

Thereby, there can be provided a fixing apparatus which is free of the slip of a fixing belt as the moving member, and any increase to torque at the starting, as well as free of the damaging of the fixing belt by heat, the melting or damaging of the supporting member for the heating member by the excessive temperature rise and which is thus excellent in safety.

The image forming apparatus according to the present invention is an image forming apparatus having image forming means for causing an unfixed toner image to be formed and borne on a recording material, and image heating and fixing means for permanently securing the unfixed toner image on the recording material, characterized in that the image heating and fixing means is the above-described heating apparatus.

Preferably, the image forming apparatus is a color image forming apparatus for superimposing toner image of a plurality of colors one upon another to thereby form a color image.

According to the present invention, there can be provided an on-demand heating apparatus like a film fixing apparatus which accurately effects the temperature control of a heating member, i.e., a moving member sliding relative to the heating member and at the same time, prevents the occurrence of problems such as the slip of the moving member and an increase in driving torque, and which is free of the damaging of the moving member by heat as well as free of the melting or damaging of a supporting member for the heating member, and the damaging of the heating member.

DESCRIPTION OF THE PREFERRED EMBODIMENTS

Some embodiments of the present invention will hereinafter be described.

First Embodiment (1) Example of an Image Forming Apparatus

Figure 1:
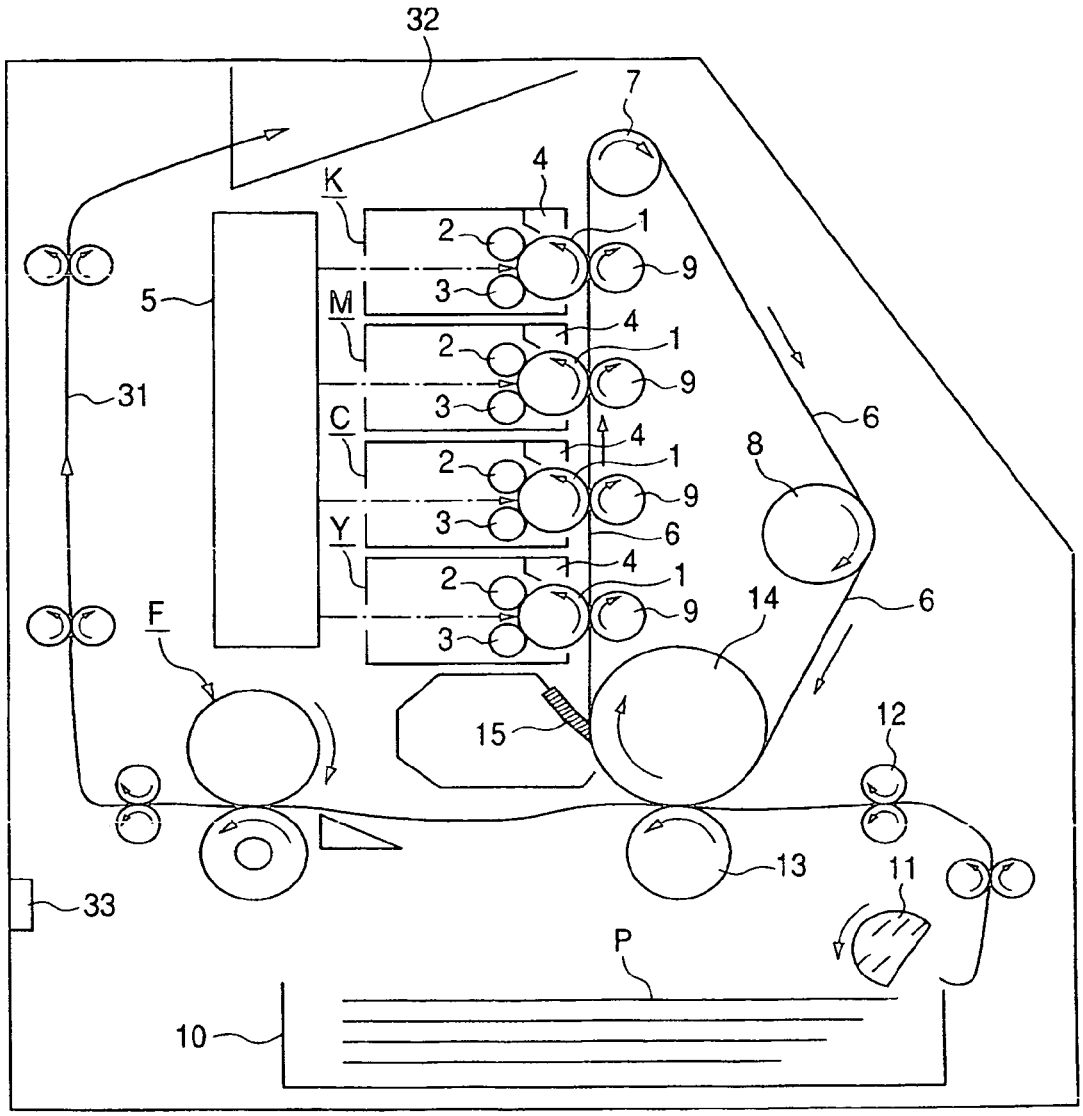
FIG. 1 schematically shows the construction of a color image forming apparatus according to a first embodiment.

FIG. 1 schematically shows the construction of a color image forming apparatus which is an embodiment of the present invention. This color image forming apparatus is an apparatus for superimposing toner images of four colors, i.e., yellow, cyan, magenta and black, one upon another by the use of an electrophotographic method to thereby obtain a full-color image, and the process speed thereof is 90 mm/sec., and the number of printed sheets per minute is 16 sheets of U.S. letter size paper. Also, the first page out time (FPOT) is about 15 seconds.

Process cartridge designated by Y, C, M and K are four process cartridges for forming yellow, cyan, magenta and black color toner images, respectively, and are arranged in succession from below to above. As each of the process cartridges Y, C, M and K, use is made of a so-called all-in-one cartridge having in one container a photosensitive drum 1 which is an image bearing member, a charging roller 2 which is charging means, developing means 3 for visualizing an electrostatic latent image, and cleaning means 4 for the photosensitive drum. The developing means 3 of the yellow process cartridge Y is filled with a yellow toner, the developing means 3 of the cyan process cartridge C is filled with a cyan toner, the developing means 3 of the magenta process cartridge M is filled with a magenta toner, and the developing means 3 of the black process cartridge K is filled with a black toner.

Optical systems 5 for effecting exposure on the photosensitive drums 1 to thereby form electrostatic latent images are provided correspondingly to the process cartridges Y, C, M and K of the four colors. As the optical systems 5, use is made of laser scanning exposure optical systems.

In each of the process cartridges Y. C, M and K, scanning exposure based on image data is effected from the optical system 5 onto the photosensitive drum 1 uniformly charged by the charging means 2, whereby an electrostatic latent image corresponding to a scanning exposure image is formed on the surface of the photosensitive drum. A developing bias applied from a bias voltage source, not shown, to the developing roller of the developing means 3 is set to an appropriate value between charging potential and latent image (exposed portion) potential, whereby the toner charged to the negative polarity selectively adheres to the electrostatic latent image on the photosensitive drum 1, and developing is thus effected.

That is, a yellow toner image is formed on the photosensitive drum 1 of the yellow process cartridge Y, a cyan toner image is formed on the photosensitive drum 1 of the cyan process cartridge C, a magenta toner image is formed on the photosensitive drum 1 of the magenta process cartridge M, and a black toner image is formed on the photosensitive drum 1 of the black process cartridge K.

The above-described single-color toner images developed and formed on the photosensitive drums 1 of the respective process cartridges Y, C, M and K are successively superimposed in a predetermined aligned state onto an intermediate transferring member 6 rotated at a substantially equal speed to and in synchronism with the rotation of the respective photosensitive drums 1 and are primary-transferred thereto, whereby a full-color toner image is formed on the intermediate transferring member 6.

In the present embodiment, an endless intermediate transferring belt is used as the intermediate transferring member 6, and is passed over three rollers, i.e., a drive roller 7, a secondary transferring roller opposed roller 14 and a tension roller 8, and is driven by the drive roller 7.

A primary transferring roller 9 is used as primary transferring means for transferring the toner images from the photosensitive drums 1 of the respective process cartridges Y, C, M and K onto the intermediate transferring belt 6. A primary transferring bias opposite in polarity to the toners is applied from a bias voltage source, not shown, to the primary transferring roller 9, whereby the toner images are primary-transferred from the photosensitive drums 1 of the respective process cartridges Y, C, M and K to the intermediate transferring belt 6.

In the respective process cartridges Y, C, M and K, any toners remaining as untransferred toners on the photosensitive drums 1 after the primary transfer from the photosensitive drums 1 to the intermediate transferring belt 6 are removed by the cleaning mans 4. In the present embodiment, blade cleaning by a urethane blade is used as the cleaning means 4.

The above-described steps are carried out in the yellow, cyan, magenta and black process cartridges Y, C, M and K in synchronism with the rotation of the intermediate transferring belt 6 to thereby successively form primary-transferred toner images of the respective colors on the intermediate transferring belt 6 in superimposed relationship with one another. In the case of image forming of only a single color (single color mode), the above-described steps are carried out only for a desired color.

On the other hand, transferring materials P set in a transferring material cassette 10 which is a transferring material supplying portion are fed one by one by a feeding roller H, and transported to the nip portion between the intermediate transferring belt 6 portion passed over the secondary transferring roller opposed roller 14 and a secondary transferring roller 13 as secondary transferring means at predetermined control timing by registration rollers 12.

The primary-transferred toner images formed on the intermediate transferring belt 6 are collectively transferred onto the transferring material P by a bias opposite in polarity to the toners applied from bias applying means, not shown, to the secondary transferring roller 13 which is the secondary transferring means.

Any secondary-untransferred toners remaining on the intermediate transferring belt 6 after the secondary transfer are removed by intermediate transferring belt cleaning means 15. In the present embodiment, like the cleaning means 4 for the photosensitive drums 1, intermediate transferring member cleaning by a urethane blade is effected.

The toner images secondary-transferred onto the transferring material P pass through a fixing apparatus F which is fixing means, whereby they are fused and fixed on the transferring material P, which passes a sheet delivery path 31 and is fed out to a sheet delivery tray 32, thus providing the output image of the image forming apparatus.

(2) Fixing Apparatus F

Figure 2:
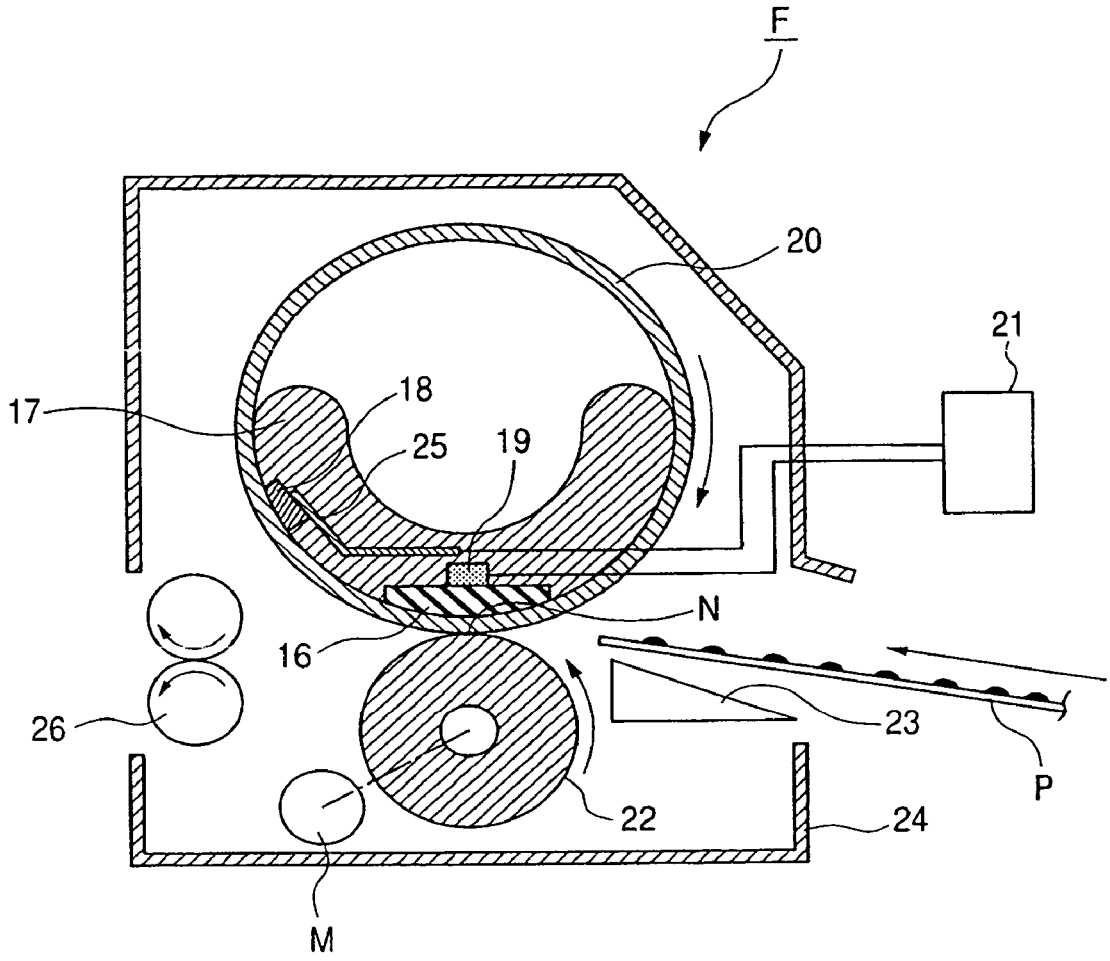
FIG. 2 is a cross-sectional model view of a fixing apparatus according to the first embodiment.

FIG. 2 is a model view schematically showing the construction of the fixing apparatus F. This fixing apparatus F is a heating apparatus of a fixing belt heating type and a pressure rotary member driving type (tensionless type).

1) General Construction of the Apparatus F

The reference numeral 20 designates a fixing belt (moving member) as a first fixing member, which is a cylindrical (endless belt-shaped) member comprising a belt-shaped member provided with an elastic layer. This fixing belt 20 will be described in detail in item 3) below.

The reference numeral 22 denotes a pressure roller (pressure member) as a second fixing member. The reference numeral 17 designates a heat-resistant and rigid heater holder of a trough shape having a substantially semicircular transverse cross-sectional shape, and the reference numeral 16 denotes a fixing heater as a heat source (heating member) which is disposed on the underside of the heater holder 17 along the length of the holder. The fixing belt 20 is loosely fitted on this heater holder 17. In the present embodiment, the fixing heater 16 is such a ceramic heater as will be described in detail in item 2) below.

The heater holder 17 is formed of highly heat-resistant liquid crystal polymer resin, and performs the role of holding the fixing heater 16 and guiding the fixing belt 20. In the present embodiment, ZENITE 7755™ produced by DuPont Co. is used as the liquid crystal polymer. The maximum usable temperature of ZENITE 7755 is about 270° C.

The pressure roller 22 is constructed by forming a silicone rubber layer having a thickness of about 3 mm on a mandrel of stainless steel by injection molding, and covering it with a PFA resin tube having a thickness of about 40 μm. This pressure roller 22 has the opposite end portions of its mandrel rotatably bearing-held between the side plates on the inner part side and this side, not shown, of an apparatus frame 24. A heating assembly comprising the heater 16, the heater holder 17, the fixing belt 20, etc. is disposed on the upper side of the pressure roller 22 in parallel to the pressure roller 22 with the heater 16 side thereof facing downwardly, and the opposite end portions of the heater holder 17 are biased in the axial direction of the pressure roller 22 with a one-side force of 98N and a total pressure force of 196N, whereby the downwardly facing surface of the fixing heater 16 is brought into pressure contact with the elastic layer of the pressure roller 22 with the fixing belt 20 interposed therebetween with a predetermined pressure force against the elasticity of the elastic layer to thereby form a fixing nip portion N having a predetermined width necessary for heating and fixing. A pressure mechanism has a pressure releasing mechanism, and is designed to release pressure during jam treatment or the like, and easily remove the transferring material P.

The reference numerals 18 and 19 designate a main thermistor and a sub-thermistor, respectively, as first temperature detecting means and second temperature detecting means. The main thermistor 18 as the first temperature detecting means is disposed in non-contact with the fixing heater 16 which is a heat source, and in the present embodiment, it is elastically brought into contact with the inner surface of the fixing belt 20, and detects the temperature of the inner surface of the fixing belt 20. The sub-thermistor 19 as the second temperature detecting means is disposed at a location nearer to the fixing heater 16 which is the heat source than the main thermistor 18, and in the present embodiment, it is brought into contact with the back of the fixing heater 16, and detects the temperature of the back of the fixing heater.

The main thermistor 18 has a thermistor element attached to the tip end of an arm 25 of stainless steel fixedly supported by the heater holder 17, and by the arm 25 being resiliently swung, it is kept in a state in which the thermistor element is always in contact with the inner surface of the fixing belt 20 even when the movement of the inner surface of the fixing belt 20 becomes unstable.

Figure 3:
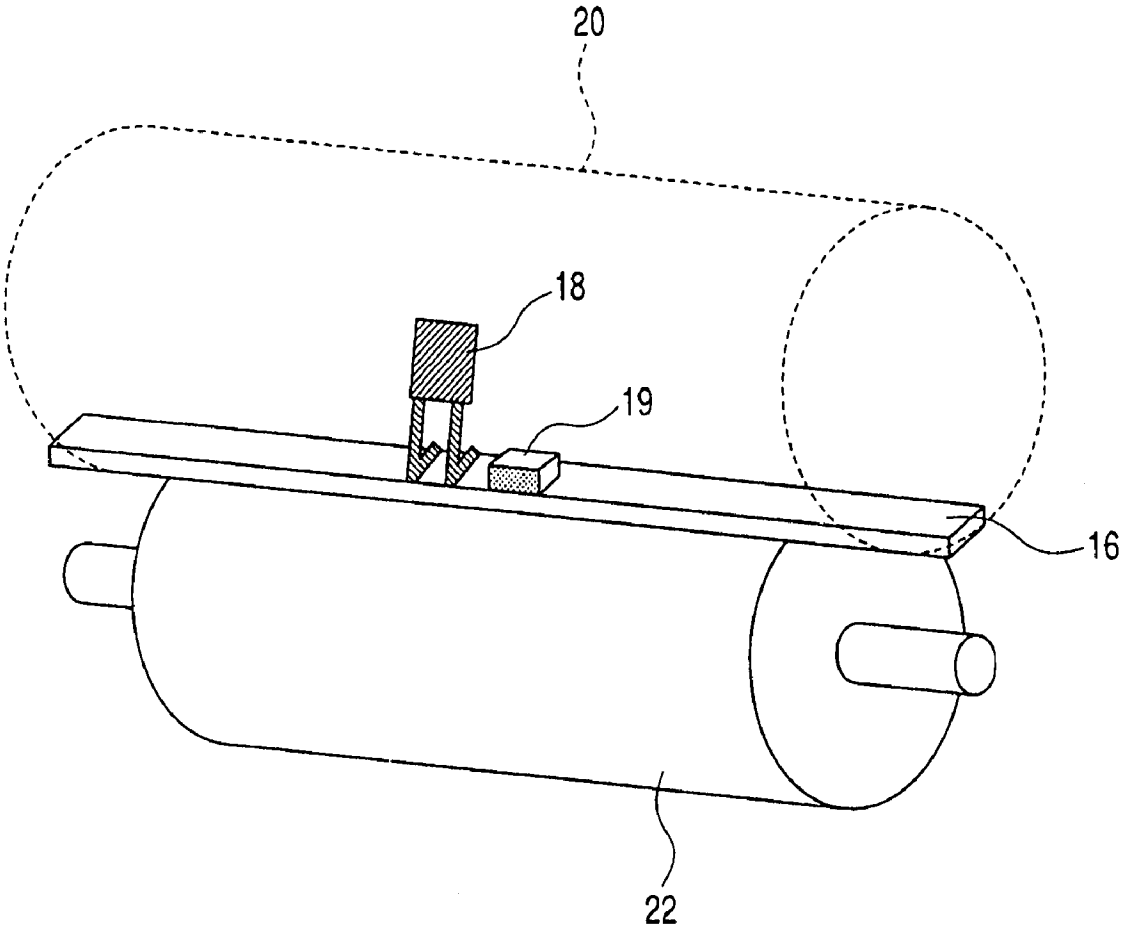
FIG. 3 is a perspective model view showing the positional relation among a fixing heater, a main thermistor and a sub-thermistor.

FIG. 3 is a perspective model view representing the positional relation among the fixing heater 16, the main thermistor 18 and the sub-thermistor 19 in the fixing apparatus of the present embodiment. Both of the main thermistor 18 and the sub-thermistor 19 are disposed near the lengthwise center of the fixing heater 16, and are disposed so as to contact with the inner surface of the fixing belt 20 and the back of the fixing heater 16, respectively.

Figure 4A:
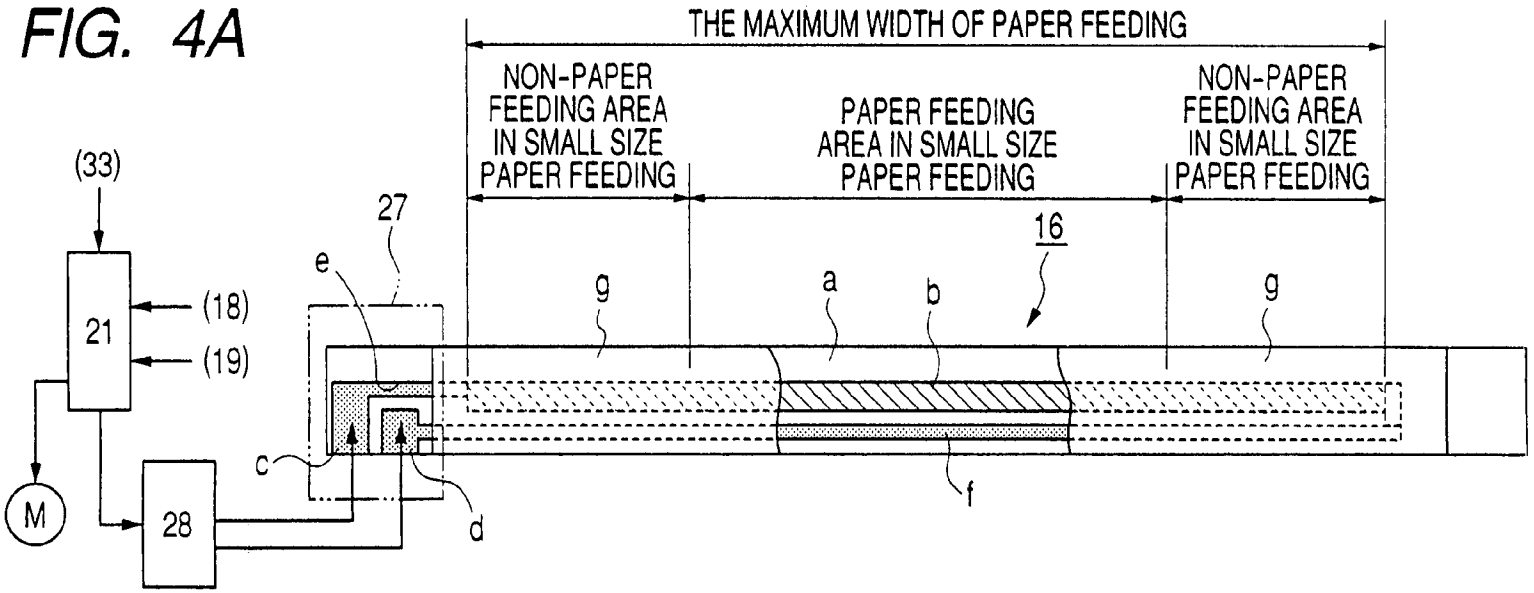
FIG. 4A is a partly cut-away surface view of a fixing heater (ceramic heater).
Figure 4B:
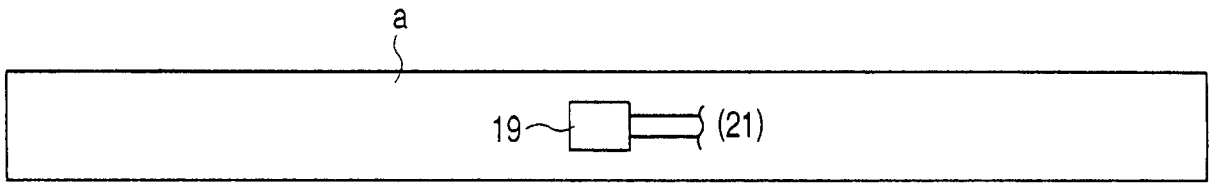
FIG. 4B is a back view of the fixing heater.
Figure 4C:
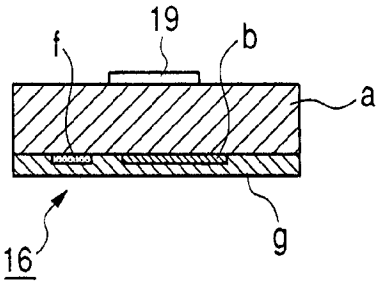
FIG. 4C is an enlarged transverse cross-sectional view of the fixing heater.

The main thermistor 18 and the sub-thermistor 19 are connected to a control circuit portion (CPU) 21, which determines the substance of the temperature control of the fixing heater 16 on the basis of the outputs of the main thermistor 18 and the sub-thermistor 19, and controls the electrical energization of the fixing heater 16 by a heater driving circuit portion 28 (FIGS. 4A to 4C).

The reference numerals 23 and 26 denote an entrance guide and a fixing and sheet delivery roller, respectively, assembled to the apparatus frame 24. The entrance guide 23 performs the role of guiding the transferring material P so that the transferring material P having passed through a secondary transferring nip may be accurately guided to the fixing nip portion N. The entrance guide 23 in the present embodiment is formed of polyphenylene sulfide (PPS) resin.

The pressure roller 22 is rotatively driven at a predetermined peripheral speed in the counter-clockwise direction of arrow by driving means M. A rotating force acts on the cylindrical fixing belt 20 by a pressure contact frictional force in the fixing nip portion N between the outer surface of the pressure roller 22 and the fixing belt 20 by this rotative driving of the pressure roller 22, and the fixing belt 20 becomes driven to rotate in the clockwise direction of arrow around the heater holder 17 while the inner surface side of the fixing belt 20 slides in close contact with the downwardly facing surface of the fixing heater 16. Grease is applied to the inner surface of the fixing belt 20 to thereby secure the slidability of the heater holder 17 and the inner surface of the fixing belt 20.

In a state in which the pressure roller 22 is rotatively driven and therewith, the cylindrical fixing belt 20 becomes driven to rotate, and the fixing heater 16 is electrically energized and rises in temperature and has risen to a predetermined temperature and has been temperature-controlled, the transferring material P bearing an unfixed toner image thereon is guided to and introduced into between the fixing belt 20 and the pressure roller 22 in the fixing nip portion N along the entrance guide 23, and in the fixing nip portion N, the toner image bearing surface side of the transferring material P is in close contact with the outer surface of the fixing belt 20 and the transferring material is nipped by and transported through the fixing nip portion N together with the fixing belt 20. In this nipping and transporting process, the heat of the fixing heater 16 is imparted to the transferring material P through the fixing belt 20, and the unfixed toner image on the transferring material P is heated and pressurized and fused and fixed on the transferring material P. The transferring material P having passed through the fixing nip portion N is curvature-separated from the fixing belt 20 and is delivered by fixing and sheet delivery rollers 26.

2) Fixing Heater 16

In the present embodiment, as the fixing heater 16 as a heat source, use is made of a ceramic heater provided by applying electrically conducting paste including a silver-palladium alloy into a film shape of a uniform thickness on an alumina substrate by the screen printing method to thereby form a resistance heat generating member, and coating it with a glass coat by pressure-resisting glass.

FIGS. 4A to 4C are structural model views of an example of such a ceramic heater, FIG. 4A being a partly cut-away surface view, FIG. 4B being a back view thereof, and FIG. 4C being an enlarged transverse cross-sectional view.

This fixing heater 16 comprises:

i) a sideways long alumina substrate a having as its lengthwise direction a direction orthogonal to a paper feeding direction;

ii) a resistance heat generating material layer b of electrically conductive paste including a silver-palladium (Ag/Pd) alloy generating heat by an electric current flowing therethrough and coating the surface side of the above-mentioned alumina substrate a along the length thereof by screen printing, and having a thickness of the order of 10 μm and a width of the order of 1–5 mm;

iii) first and second electrode portions c and d and extended circuit portions e and f pattern-formed as an electric power supplying pattern for the above-mentioned resistance heat generating material layer b also on the surface side of the alumina substrate a as by the screen printing of silver paste;

iv) a thin glass coat g having a thickness of the order of 10 μm formed on the resistance heat generating material layer b and the extended circuit portions e and f to assure the protection and insulativeness thereof and capable of resisting the sliding friction with the fixing belt 20; and v) the sub-thermistor 19 provided on the back side of the alumina substrate a.

The above-described fixing heater 16 is fixed to and supported by the heater holder 17 with the surface side thereof exposed downwardly.

An electrically energizing connector 27 is mounted on the first and second electrode portions c and d side of the fixing heater 16. Electric power is supplied from a heater driving circuit portion 28 to the first and second electrode portions c and d through the electrically energizing connector 27, whereby the resistance heat generating material layer b generates heat and the fixing heater 16 quickly rises in temperature. The heater driving circuit portion 28 is controlled by a control circuit portion 21.

In ordinary use, the driven rotation of the fixing belt 20 starts with the start of the rotation of the pressure roller 22, and with the rise of the temperature of the fixing heater 16, the temperature of the inner surface of the fixing belt 20 also rises. The electrical energization of the fixing heater 16 is controlled by PID control, and input electric power is controlled so that the temperature of the inner surface of the fixing belt 20, i.e., the detected temperature by the main thermistor 18, may become 195° C.

3) Fixing Belt 20

The fixing belt 20 comprises endless film provided by forming polyimide resin into a cylindrical shape having a thickness of 50 μm, a silicone rubber layer as an elastic layer formed on the endless film by a ring coat method, and a PFA resin tube having a thickness of 30 μm covering the silicone rubber layer.

It is desirable from the viewpoint of temperature raising to use a material having high heat conductivity to the utmost as the silicone rubber layer, and make the heat capacity of the fixing belt 20 small. In the present embodiment, use was made of a material having heat conductivity of about $4.19\times10^{-3}$ J/sec.cm.K belonging to a class of high heat conductivity as silicone rubber.

On the other hand, from the viewpoint of the quality of image such as OHT transmissivity and "spot" on an image (minute unevenness of gloss), it is desirable to make the rubber layer of the fixing belt 20 thick to the utmost. According to the studies, it has been found that to obtain a quality of image at a satisfactory level, a thickness of rubber equal to or greater than 200 μm is necessary. The silicone rubber layer in the present embodiment had a thickness of 250 μm.

When the heat capacity of the thus formed fixing belt 20 was measured, it was $1.17\times10^{-1}$ J/cm$^2$ K (heat capacity per 1 cm$^2$ of the fixing belt). Generally, when the heat capacity of the fixing belt 20 becomes 4.19 J/cm$^2$ k or greater, temperature rising becomes slow and the on-demand property is spoiled. Also, when conversely, an attempt is made to make the heat capacity of the fixing belt 20 equal to or less then $4.19\times10^{-2}$ J/cm$^2$ K, the rubber layer of the fixing belt 20 cannot help being made extremely thin, and it is impossible to secure the thickness of the rubber layer necessary to maintain the quality of image such as OHT transmissivity and the level of "spot". Thus, it will be seen that the heat capacity of the fixing belt 20 which satisfies both of the on-demand property and the quality of image is within a range of $4.19\times10^{-2}$ J/cm$^2$ K to 4.19 J/cm$^2$ K.

Further, a fluorine resin layer can be provided on the surface of the fixing belt 20 to thereby improve the mold releasing ability of the surface and prevent an offset phenomenon occurring due to the toners once adhering to the surface of the fixing belt 20, and again moving to the transferring material P.

Also, it becomes possible to make the fluorine resin layer on the surface of the fixing belt 20 into a PFA tube to thereby form a uniform fluorine resin layer more simply.

(3) Control of the Fixing Heater 16

In the present embodiment, to satisfy FPOT 15 seconds, it is necessary for the fixing nip portion N to have risen to a predetermined temperature before the transferring material P rushes into the fixing nip portion N. When the time from after printing has been started until the transferring material P rushes into the fixing nip portion N was measured, it was about 11 seconds. Accordingly, by the temperature of the fixing apparatus rising within 11 seconds, it becomes possible to provide a fixing apparatus having a high on-demand property without affecting FPOT.

Figure 5:
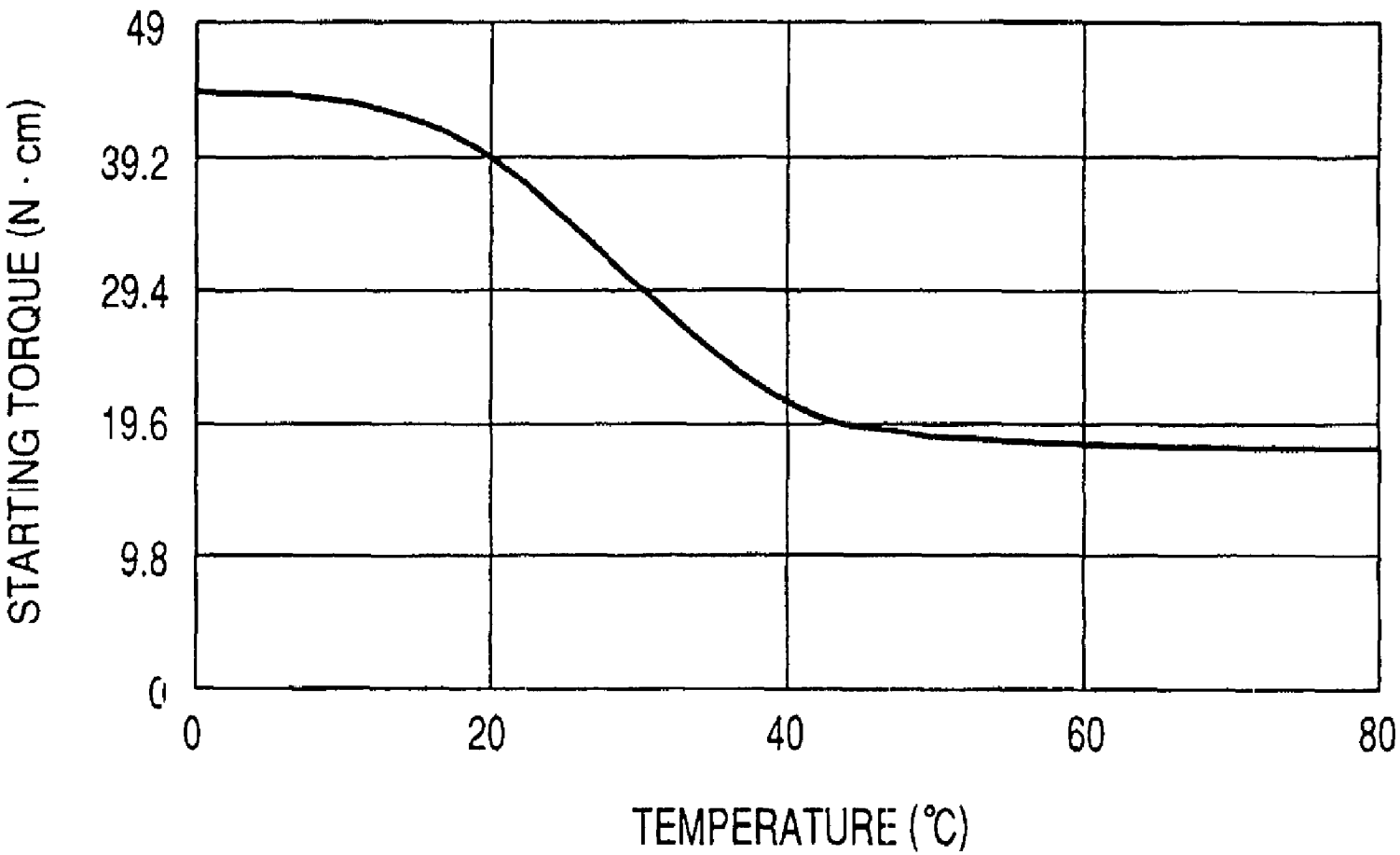
FIG. 5 is a graph showing the temperature of the sub-thermistor and the driving torque of the apparatus.

FIG. 5 shows the result of the measurement of the starting torque of the fixing apparatus in the present embodiment. It shows the starting torque for the sub-thermistor detection temperature (heater temperature).

In the present construction, if the sub-thermistor detection temperature (heater temperature) is about 50° C. or higher, the starting torque is about 19.6 N·cm or less, and there was not seen the occurrence of the slip of the fixing belt caused during starting by an torque increase due to the securement of the grease in the nip.

On the other hand, when the sub-thermistor detection temperature (heater temperature) is lower than about 50° C., the starting torque is greater than about 19.6 N·cm and the slip of the fixing belt may occur.

Particularly under a low-temperature environment, it becomes more remarkable, and the starting torque when for example, an apparatus left under an environment of 15° C. or lower for a long time was started was about 39.2 N·cm, and in this case, the slip of the fixing belt was observed.

So, the present embodiment is designed to execute an operating mode in which the temperature state of the fixing heater 16 at the starting of the apparatus is detected by the sub-thermistor 19 which is the second temperature detecting means, and on the basis of the result of the detection, the control circuit portion 21 is made to judge whether the electrical energization of the fixing heater 16 should be effected before the start of the rotative driving of the fixing belt 20, i.e., before the start of the driving of the pressure roller 22, and the starting time of the apparatus is started after the predetermined electrical energization of the fixing heater 16, or an operating mode in which the starting time of the apparatus is started without the electrical energization of the fixing heater.

Figure 6:
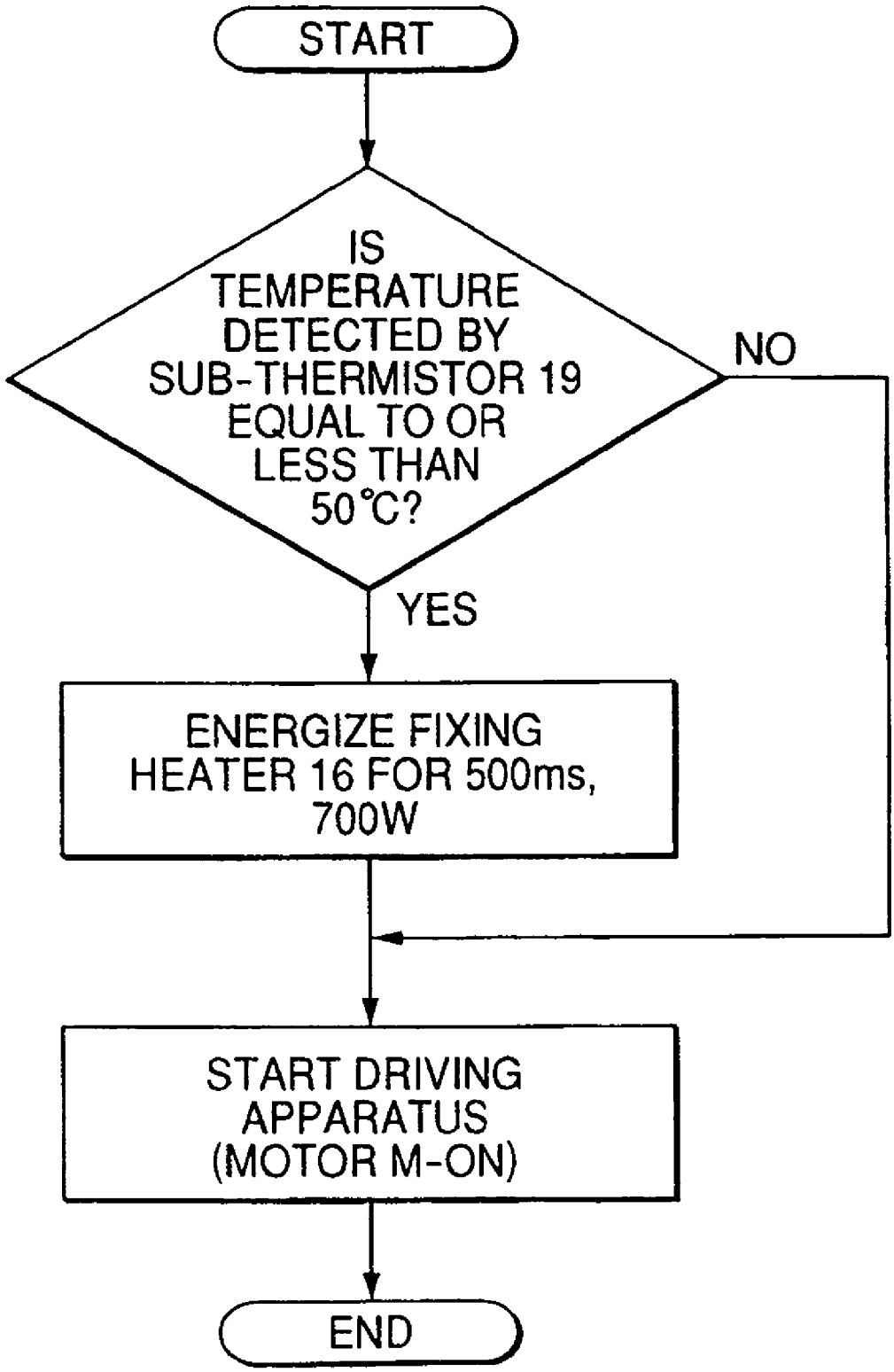
FIG. 6 is a control flow chart in the first embodiment.

Specifically, as shown in FIG. 6, when the sub-thermistor detection temperature (heater temperature) was 50° C. or lower, the electrical energization of the fixing heater 16 was started before the start of driving to thereby fuse the grease, and then the starting was started. In the present embodiment, electric power of about 700 W was supplied for 500 ms, where after the driving was started. The torque at this starting time of the driving was about 17.6 N·cm and there was not seen the occurrence of the slip of the fixing belt. When as in the present embodiment, the sub-thermistor detection temperature is 50° C. or low as described above, the electrical energization of the heater is started before the start of the driving to thereby fuse the grease, and then the starting is started, whereby it has become possible to provide a fixing apparatus which can always maintain torque of about 19.6 N·cm or less and which is always free of the occurrence of the slip of the fixing belt.

When the sub-thermistor detection temperature is higher than 50° C., shift is intactly made to the start of the starting.

After the start of the driving of the apparatus, the control circuit portion 21 detects the temperature of the fixing belt 20 by the main thermistor 18 which is the first temperature detecting means, and on the basis of the result of the detection, the electric power supplied from a heater driving circuit portion 28 to the fixing heater 16 is controlled so that the temperature of the fixing belt 20 detected by the main thermistor 18 may be maintained at a predetermined controlled temperature.

Figure 7:
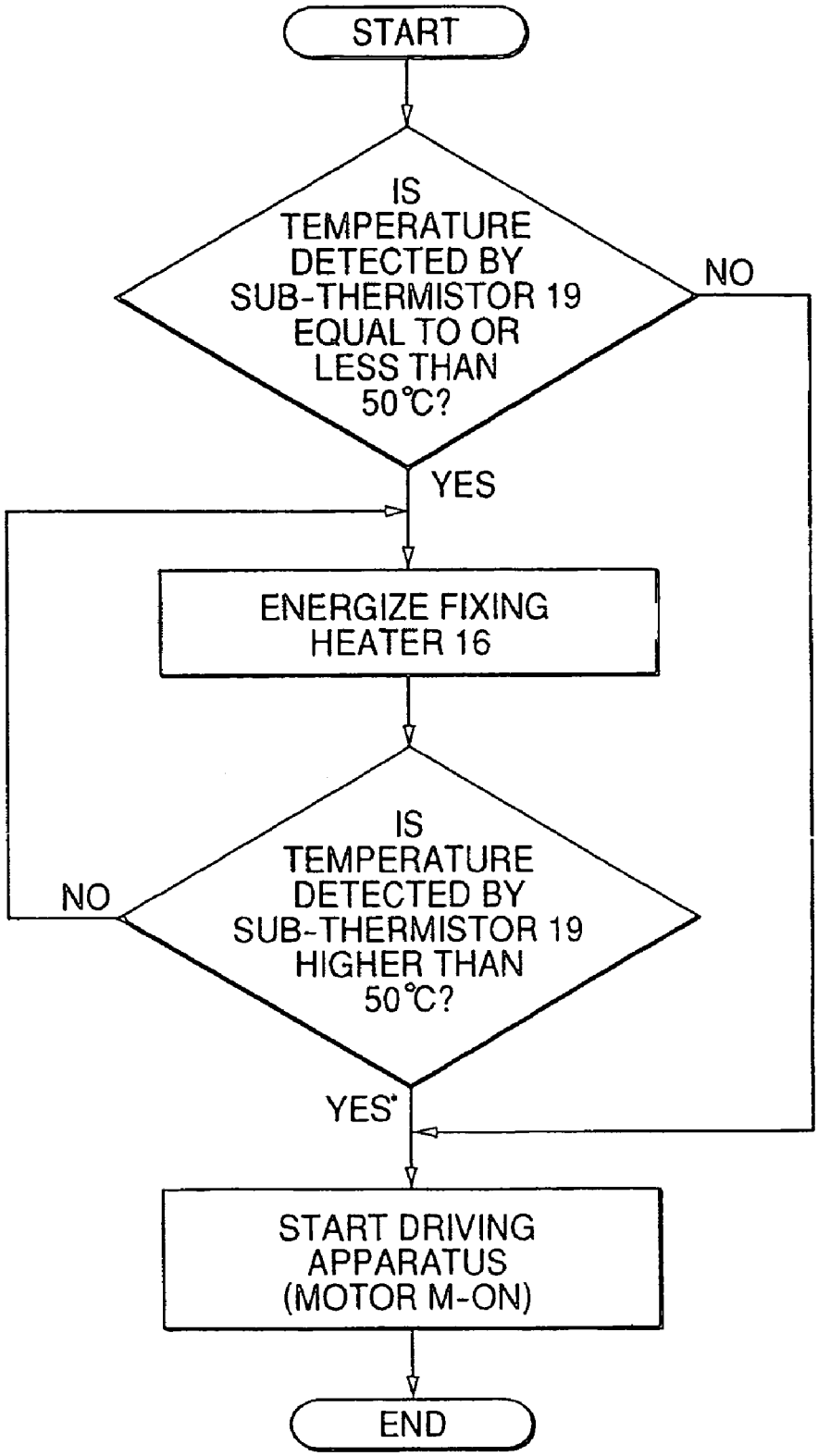
FIG. 7 is another control flow chart in the first embodiment.

In the present embodiment, when at the starting of the apparatus, the sub-thermistor detection temperature was 50° C. or lower, the electrical energization of the fixing heater 61 was effected for a predetermined time (500 ms) before the start of the driving, but of course, there may be adopted a construction in which the sub-thermistor temperature is detected and electrical energization is effected until a temperature free of the occurrence of the slip of the fixing belt is reached, whereafter the start of the driving is effected. There may be adopted such a construction as shown, for example, in FIG. 7 wherein when the sub-thermistor temperature is 50° C. or lower, electrical energization is started before driving, and the electrical energization is effected until the sub-thermistor temperature exceeds 50° C., whereafter rotative driving is started, to obtain a similar effect.

Second Embodiment

This embodiment is one which uses, instead of the sub-thermistor 19 used in the first embodiment, an environment sensor 33, as third temperature detecting means (FIGS. 1 and 2) installed in the apparatus and capable of detecting the atmospheric temperature. The rough construction of the fixing apparatus is similar to that of the first embodiment, but this embodiment is characterized in that whether electrical energization should be effected before the start of driving is determined on the basis of the result of the detection by the environmental sensor 33.

In the present embodiment, when a low-temperature environment is detected by the environment sensor 33, the heater is electrically energized before the start of driving to thereby start image forming. Thereby, under the low-temperature environment, the solidified grease is always fused and thereafter the driving is started and therefore, there was not seen the occurrence of the slip of the film caused by the solidification of the grease.

Table 1 below shows the occurrence situation of the slip of the fixing belt at the start of the driving to environmental temperatures.

TABLE 1

| Detected Environmental Temperature (° C.) | Film Slip |
|---|---|
| 10 | Not Good - occurred frequently |
| 15 | Not Good - sometimes occurred |
| 20 | OK No - occurrence |
| 25 | OK No - occurrence |

In the case of the construction of the fixing apparatus used in the present embodiment, the occurrence of the slip was substantially not seen if the environmental temperature was 20° C. or higher. When the environmental temperature was below 20° C., the slip began to occur, and at 15° C. or lower, the starting torque was about 39.2 N·cm and the occurrence of the slip was seen. At 10° C. or lower, the starting torque became about 41.2 N·cm or greater, and the occurrence of the slip came to be seen frequently.

Figure 8:
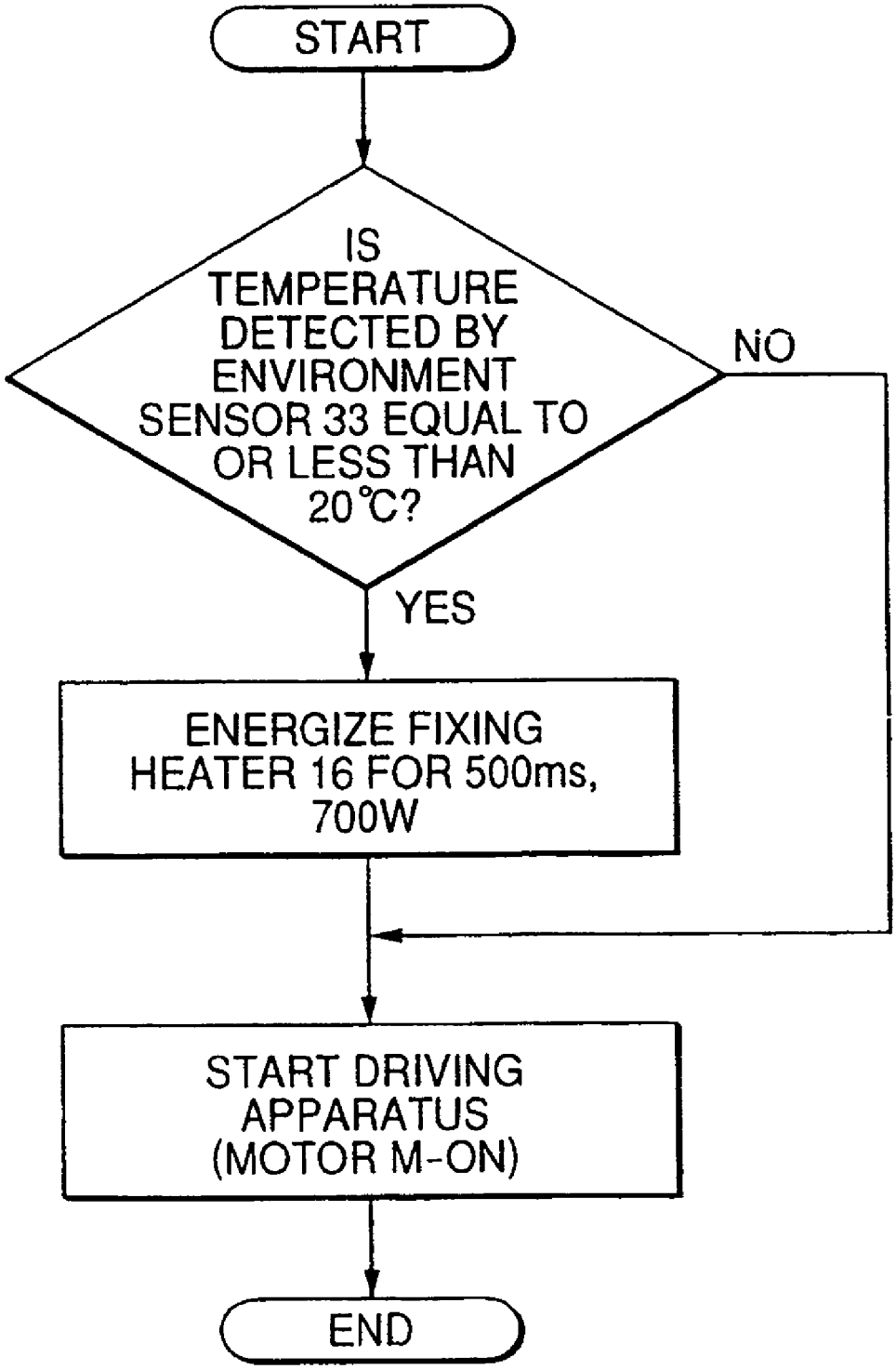
FIG. 8 is a control flow chart in a second embodiment.

So, in the present embodiment, there has been adopted a construction as shown in FIG. 8 wherein when an environmental temperature of 20° C. or lower is detected by the environment sensor 33, the fixing heater 16 is electrically energized (e.g. for 500 ms at about 700 W) before rotative driving to thereby fuse the grease, whereafter rotative driving is started. Thereby, under all environments, whether the heater should be electrically energized before the driving can be judged on the basis of the information of this environment sensor 33, whereby it has become possible to provide an image fixing apparatus which is always free of the occurrence of the slip of the fixing belt.

Third Embodiment

This embodiment is characterized in that the environment is detected by the use of the environment sensor 33 (FIGS. 1 and 2, third temperature detecting means) installed in the apparatus and capable of detecting the atmospheric temperature, and the temperature of the fixing heater 16 is detected by the sub-thermistor 19 which is the second temperature detecting means, and on the basis of the result of the detection by both of them, whether the fixing heater 16 should be electrically energized before the driving is determined.

For example, in a case where only the sub-thermistor temperature is to be detected, when a temperature at which the grease has been sufficiently fused is judged from the result of the detection of the sub-thermistor temperature, electrical energization is not effected before the start of the driving, but yet when the installation environment of the apparatus was a very low temperature environment, there was seen a case where the fusion of the grease was insufficient.

Figure 9:
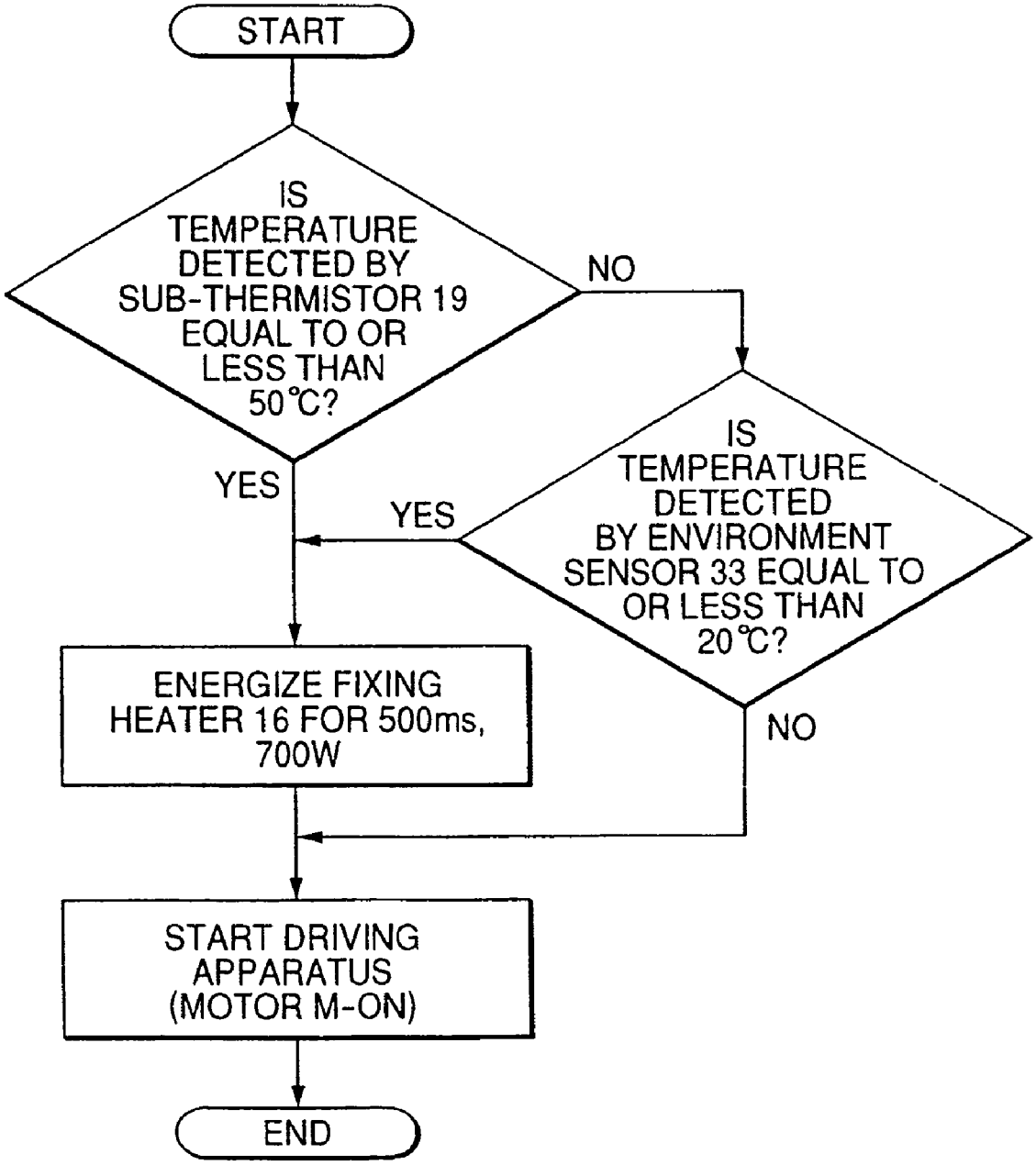
FIG. 9 is a control flow chart in a third embodiment.

In order to avoid such a state, in the present embodiment, as shown in FIG. 9, design is made such that when a very low temperature environment is detected by the environment sensor 33, the start of electrical energization is effected before the driving, irrespective of the detected temperature by the sub-thermistor.

As described above, in all situations, whether the electrical energization of the heater should be effected before the driving can always be judged on the basis of the information of the environment sensor 33 and the temperature detection information of the sub-thermistor, whereby it has become possible to provide a fixing apparatus which prevents the occurrence of such problems as the slip of the fixing belt and any increase in driving torque and which is free of the damaging of the fixing belt by heat, the melting or damaging of the supporting member for the heater, and the damaging of the heater.

Figure 10:
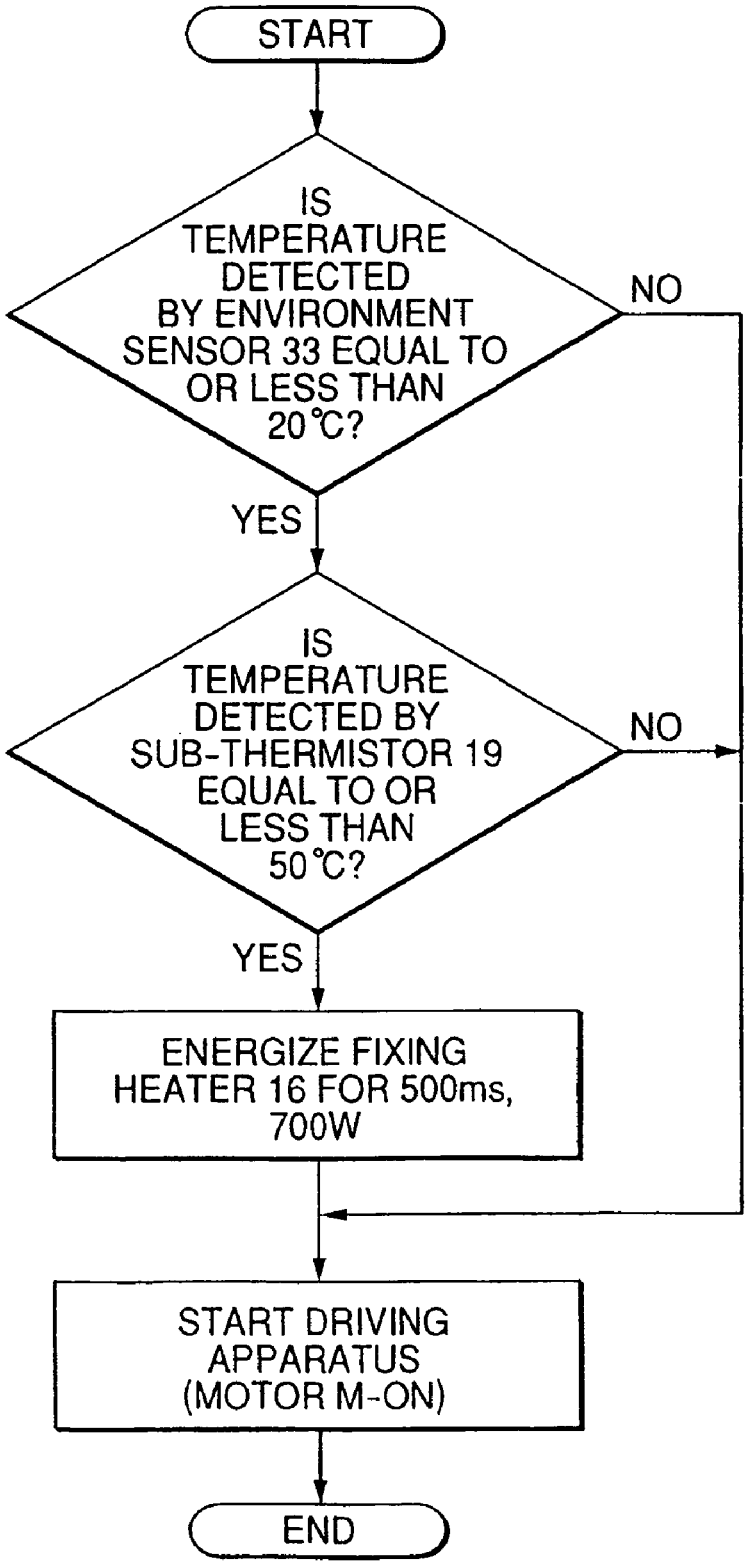
FIG. 10 is another control flow chart in the third embodiment.

Also, while in the present embodiment, the electrical energization of the heater before the start of the driving is judged from both of the information of the environment sensor 33 and the temperature detection information of the sub-thermistor there may be adopted a construction as shown in FIG. 10 wherein whether the sub-thermistor temperature should be detected is judged on the basis of the information of the environment sensor 33, and when it is judged that the sub-thermistor temperature should be detected, whether the electrical energization of the heater should be started before the start of the driving is judged on the basis of the result of the detection of the sub-thermistor temperature, to obtain a similar effect.

Fourth Embodiment

This embodiment is characterized in that a metal fixing belt having a metal as its base is used as the fixing belt 20.

Figure 11:
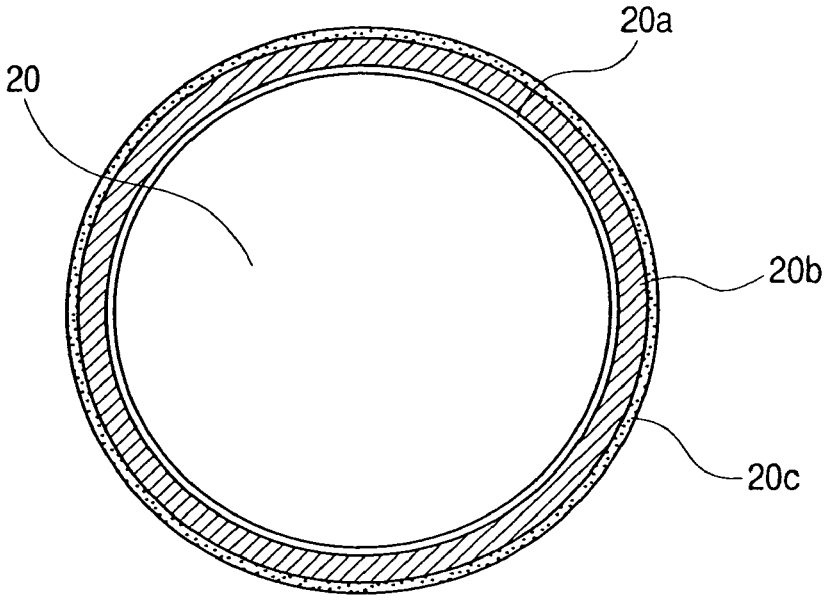
FIG. 11 is a cross-sectional model view of a fixing belt in a fourth embodiment.
Figure 12:
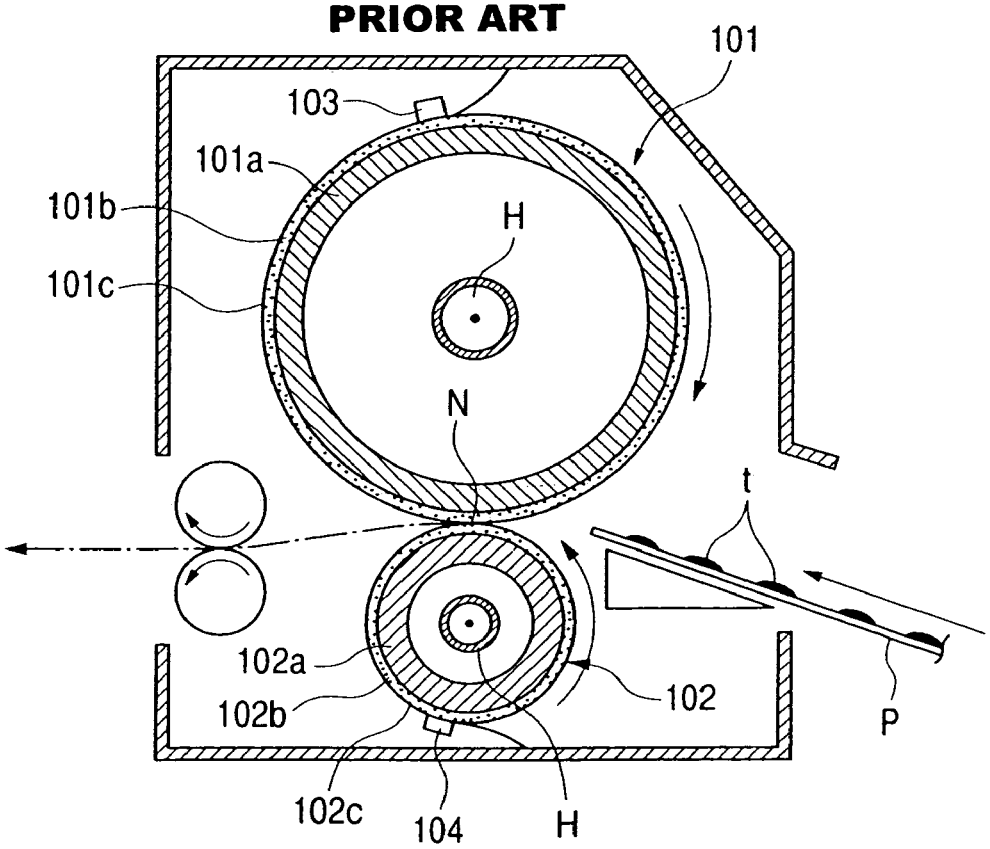
FIG. 12 PRIOR ART
FIG. 12 is a cross-sectional view of a conventional heat roller type fixing apparatus.
Figure 13:
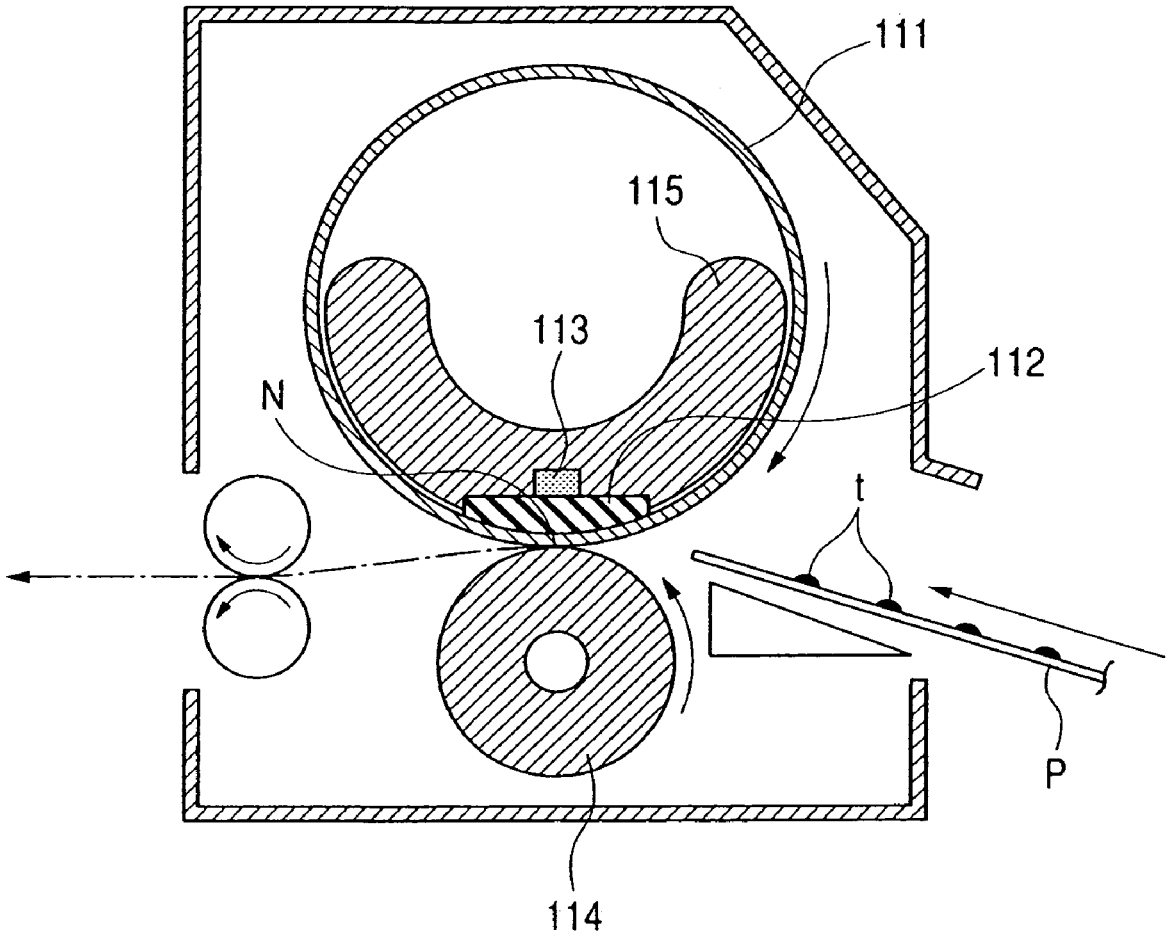
FIG. 13 PRIOR ART
FIG. 13 is a cross-sectional view of a conventional film fixing type fixing apparatus.

FIG. 11 shows the fixing belt 20 used in the present embodiment. As a base layer 20*a*, use is made of an SUS belt provided by forming a blank tube of SUS into a seamless belt shape having a thickness of 50 μm by drawing. A rubber layer 20*b* and a mold releasable layer 20*c* were formed on the SUS belt, as in the first embodiment and the second embodiment, to thereby obtain the fixing belt 20 of the present embodiment.

In a case where the fixing belt 20 of the present embodiment was applied to a fixing apparatus similar to the first embodiment, and as in the first embodiment, the sub-thermistor detection temperature was 50° C. or lower, electric power of about 700 W was supplied before the start of the driving to thereby start the electrical energization of the fixing heater 16 and fuse the grease, and then the starting was started (FIG. 5). The torque at this start of the driving was about 17.6 N·cm, and there was not seen the occurrence of the slip of the fixing belt 20.

Again in a case where as in the present embodiment, use is thus made of a metal fixing belt having a metal as its base, when the sub-thermistor detection temperature is likewise 50° C. or lower, the electrical energization of the fixing heater is started before the start of the driving to thereby fuse the grease, and then the starting is started, whereby it has become possible to provide a fixing apparatus which can always maintain torque of about 19.6 N·cm or less and which is always free of the occurrence of the slip of the fixing belt.

While in the present embodiment, stainless steel is used as the base material of the fixing belt 20, use may of course be made of other metal. Specifically, copper, iron, nickel or the like is conceivable. If especially, use is made of a fixing belt base material provided by forming copper or nickel into a sleeve shape by electroforming, it becomes possible to make thin film of 40 μm or less and further, heat efficiency is high and therefore, it becomes possible to obtain a fixing belt excellent in a rising characteristic.

Fifth Embodiment

This embodiment is characterized in that a ceramic heater having not alumina but aluminum nitride as the base material a (FIG. 4) is used as the fixing heater.

The present embodiment is entirely similar in construction to the first embodiment with the exception that aluminum nitride is used as the base material a of the fixing heater 16.

Aluminum nitride used is one having heat conductivity of 95 W/m·k. In contrast with the heat conductivity 20 W/m·k of alumina, aluminum nitride has heat conductivity 4.75 times as great as the heat conductivity of alumina and therefore, even in a case where the sub-thermistor 19 is disposed on the back of the fixing heater 16, it becomes possible to detect a temperature more approximate to the temperature of the surface of the fixing heater 16.

By the present construction, it becomes possible to detect the temperature in the fixing nip more accurately by the sub-thermistor, and it becomes possible to provide a good image fixing apparatus which is always free of the occurrence of the slip of the fixing belt.

Others a) The heating means (heating member) is not restricted to the illustrated ceramic heater, but use can also be made, for example, of an SUS heater, a rear heating type heater, a positive temperature coefficient (PTC) heater, an electromagnetic induction heat-generative member or the like.

b) In the embodiment, the heating and fixing apparatus of the film heating type is of a pressure rotary member driving type, but may be an apparatus of a type in which a drive roller is provided on the inner peripheral surface of endless fixing film as a sliding member and which is driven while tension is being applied to the film. It is also possible to provide an apparatus of a construction in which the film is made into a rolled web having ends and it is driven to move.

c) The pressure rotary member may be an endless member instead of a roller member. Alto, use may be made of a pressure film unit disclosed, for example, in Japanese Patent Application Laid-Open No. 2001 -228731 which comprises an endless belt and a pressure member to achieve a smaller heat capacity.

d) The heating apparatus of the present invention is not restricted as the heating and fixing apparatus described in the embodiments, but can be widely used as an image heating apparatus for heating a recording material bearing an image thereon to thereby improve the surface property thereof such as gloss, an image heating apparatus for tentatively fixing an image, and other means and apparatuses for heating a material to be heated such as a heating and drying apparatus for a material to be heated, and a heating laminate apparatus.

While various examples and embodiments of the present invention have been described above, it will be understood by those skilled in the art that the gist and scope of the present invention are not restricted to the specific description made herein and the figures of the accompanying drawings, but cover various modifications and changes set forth in the appended claims.

What is claimed is:

1. A heating apparatus having a heating member disposed while being fixedly supported, a moving member sliding relative to said heating member, and a pressure member brought into pressure contact with said heating member with said moving member interposed therebetween to thereby form a nip, wherein a material to be heated is introduced between the moving member and the pressure member in said nip and is nipped and transported therebetween and is heated by heat from the heating member transmitted through the moving member, said heating apparatus comprising:

first temperature detecting means disposed in proximity to or in contact with said moving member;

second temperature detecting means for detecting a temperature of said heating member or an atmospheric temperature of said apparatus;

controlling means for controlling electric power supply to said heating member on the basis of a result of detection by said first temperature detecting means; and judging means for judging on the basis of a result of detection by said second temperature detecting means whether electrical energization of said heating member should be effected before the start of movement driving of said moving member.

2. A heating apparatus according to claim 1, wherein said second temperature detecting means is disposed in proximity to or in contact with said heating member, and detects the temperature of said heating member.

3. A heating apparatus according to claim 2, further having third temperature detecting means disposed inside or outside said apparatus for detecting the atmospheric temperature of said apparatus, and wherein said judging means judges on the basis of the result of the detection by both of said second temperature detecting means and said third temperature detecting means whether the electrical energization of said heating member should be effected before the start of the movement driving of said moving member.

4. A heating apparatus according to claim 1, wherein said second temperature detecting means is disposed inside or outside said apparatus, and detects the atmospheric temperature of said apparatus.

5. A heating apparatus according to claim 1, wherein said first temperature detecting means is disposed in contact with said moving member.

6. A heating apparatus according to claim 1, wherein said first temperature detecting means is disposed in contact with an inner surface of said moving member.

7. A heating apparatus according to claim 1, wherein said second temperature detecting means is disposed in contact with said moving member.

8. A heating apparatus according to claim 1, wherein said moving member is a fixing belt, and said material to be heated is a recording material bearing thereon an unfixed toner image to be heated and fixed.

9. An image forming apparatus comprising:

image forming means for causing an unfixed toner image to be formed and borne on a recording material; and image heating and fixing means for permanently securing the unfixed toner image on the recording material, wherein said image heating and fixing means includes a heating apparatus according to claim 1.

10. An image forming apparatus according to claim 9, which is a color image forming apparatus for superimposing toner images of a plurality of colors one upon another to thereby form a color image.

11. A heating apparatus having a heating member disposed while being fixedly supported, a moving member sliding relative to said heating member, and a pressure member brought into pressure contact with said heating member with said moving member interposed therebetween to thereby form a nip, wherein a material to be heated is introduced into between the moving member and the pressure member in said nip and is nipped and transported therebetween and is heated by heat from the heating member transmitted through the moving member, said heating apparatus comprising:

a first temperature detecting element disposed in proximity to or in contact with said moving member;

a second temperature detecting element for detecting a temperature of said heating member or an atmospheric temperature of said apparatus;

a controlling portion for controlling electric power supply to said heating member on the basis of a result of detection by said first temperature detecting element; and a judging portion for judging on the basis of a result of detection by said second temperature detecting element whether electrical energization of said heating member should be effected before the start of movement driving of said moving member.

12. A heating apparatus according to claim 11, wherein said second temperature detecting element is disposed in proximity to or in contact with said heating member, and detects the temperature of said heating member.

13. A heating apparatus according to claim 11, wherein said second temperature detecting element is disposed inside or outside said apparatus, and detects the atmospheric temperature of said apparatus.

14. A heating apparatus according to claim 12, further comprising a third temperature detecting element disposed inside or outside said apparatus for detecting the atmospheric temperature of said apparatus, and wherein said judging portion judges on the basis of the result of the detection by both of said second temperature detecting element and said third temperature detecting element whether the electrical energization of said heating member should be effected before the start of the movement driving of said moving member.

15. A heating apparatus according to claim 11, wherein said first temperature detecting element is disposed in contact with said moving member.

16. A heating apparatus according to claim 11, wherein said first temperature detecting element is disposed in contact with an inner surface of said moving member.

17. A heating apparatus according to claim 11, wherein said second temperature detecting element is disposed in contact with said heating member.

18. A heating apparatus according to claim 11, wherein said moving member is a fixing belt, and said material to be heated is a recording material bearing thereon an unfixed toner image to be heated and fixed.

19. An image forming apparatus having image forming means for causing an unfixed toner image to be formed and borne on a recording material, and image heating and fixing means for permanently securing the unfixed toner image on the recording material, said heating and fixing means being a heating apparatus according to claim 11.

20. An image forming apparatus according to claim 19, which is a color image forming apparatus for superimposing toner images of a plurality of colors one upon another to thereby form a color image.

* * * * *

UNITED STATES PATENT AND TRADEMARK OFFICE

CERTIFICATE OF CORRECTION

PATENT NO. : 7,054,573 B2
APPLICATION NO. : 10/808480
DATED : May 30, 2006
INVENTOR(S) : Masahide Hirai et al.

It is certified that error appears in the above-identified patent and that said Letters Patent is hereby corrected as shown below:

COVER PAGE AT ITEM (56) RC:
Foreign Patent Documents, "3051085" should read --2000-3051085--.

COLUMN 1:
Line 30, "have" should read --has--.

COLUMN 5:
Line 44, "tree" should read --free--.

COLUMN 7:
Line 30, "is" should read --is a--.
Line 42, "systems" should read --system--.

COLUMN 8:
Line 27, "mans" should read --means--.

COLUMN 10:
Line 14, "of" (second occurrence) should be deleted.
Line 35, "of" should read --of the--.
Line 41, "of" should read --of the--.

COLUMN 16:
Line 46, "Alto," should read --Also,--.

COLUMN 18:
Line 59, "heating" should read --image heating--.

Signed and Sealed this

Thirteenth Day of March, 2007

JON W. DUDAS
*Director of the United States Patent and Trademark Office*